US005843556A

United States Patent [19]

Levas

[11] Patent Number: 5,843,556

[45] Date of Patent: Dec. 1, 1998

[54] MULTI PURPOSE BEACH TOWEL, TOTE BAG, AND CHAIR COVER

[76] Inventor: Timothy J. Levas, 524 A Via De La Valle, Solana Beach, Calif. 92075

[21] Appl. No.: 692,699

[22] Filed: Aug. 6, 1996

[51] Int. Cl.[6] ..... B65D 30/00

[52] U.S. Cl. ..... 428/99; 428/131; 383/4; 190/2; 5/417; 5/419; 5/420

[58] Field of Search ..... 428/99, 100, 131; 5/417, 419, 420; 383/4; 190/2; 297/218.1, 218.2, 218.3, 218.4, 218.5

[56] References Cited

U.S. PATENT DOCUMENTS 1,745,590 2/1930 Stanger ..... 383/4
4,793,012 12/1988 LaPorte ..... 383/4

*Primary Examiner*—Alexander Thomas
*Attorney, Agent, or Firm*—Donn K. Harms

[57] ABSTRACT

A combination beach towel, tote bag, deck chair cover and automobile seat cover, which will easily convert from a beach towel to one of its other forms. Sectional side opening pockets which are concealed yet easily accessible while is in use as either a tote bag, deck chair cover, auto seat cover or beach towel. An optional locking device can removably secure the combination towel tote bag invention to a chair or other fixed object by attahment to a carrying strap. Additionally, the side opening pockets can be secured using an optional removable locking device to secure the pockets closed. Indicia optionally placed upon the invention allows for advertisements or notation of the geographical location wherein the invention is to be used. An optional proximaty metering device allows for an alarm should a certain geographic area be left by the user.

9 Claims, 2 Drawing Sheets

*Fig. 1*

MULTI PURPOSE BEACH TOWEL, TOTE BAG, AND CHAIR COVER

BACKGROUND OF THE INVENTION

1. Field of the Invention

This invention relates to an easily manufactured multi purpose combination towel and tote bag which can be easily altered by the user for use for a specific purpose. More particularly it relates to an easily manufactured combination towel, chair cover, beach mat, with side access storage pockets for valuables and the like. The invention easily converts from a beach towel, to a cover for a deck chair, to a tote bag for the user to transport desired articles to the pool, beach, or boat deck.

2. Prior Art

A favorite leisure activity throughout the world is sunbathing and swimming. Whether it be at the beach, at a pool, or on a cruise ship, it is desirable for participants in such leisure activities to transport certain convenience and necessity articles with them to the beach or pool. Items such a sun screen, sun glasses, wallets, books for leisure reading, money, and similar necessities are generally needed for such activities as both a necessity and for convenience sake.

However, as every beach goer knows, laying directly on the sand can be an unpleasant prospect as the granules end up sticking to one's body and work their way into clothing and anything else brought to the beach. Additionally bugs, tar, and other annoyances are best separated from the beach goer and his property when laying upon the ground. A conventional beach towel normally accomplishes this task.

For pool goers, whether it be on a cruise ship, at a hotel, or just at a private pool, use of conventional deck chairs have their own perils. Such chairs can be hot from sunlight, or can leave embarrassing marks upon the pool goers skin from direct contact with the plastic material used for the chairs. A conventional terry cloth type towel is again the normal conventional protectorate between the pool goer and the chair or a pool deck used to dry off or sun bathe.

To all such recreational sun bathers, whether it be at on a ship, at a hotel, at the beach, or at the pool, the task of carrying the necessities of leisure time, normally dictates that a tote bag be used. However, carrying a tote bag, a towel, a ground cover or a chair cover, sunglasses, lotion, radio, and other personal belongings necessitates carrying a number of different items. Tote bags can also be expensive and using separate towels, chair covers, and tote bags invites the losing of one or more items upon departure from the beach or pool deck. Thus, there exists a need for a multi use combination beach towel, chair cover, and tote bag which would in a practical manner, allow the user to transport necessity as well as optional items to leisure activities while providing storage and security during such activities for the owner's personal items.

U.S. Pat. No. 4,188,988 (Agyagos) teaches a multi purpose tote bag capable of being used as a beach mat. However Agyagos as taught is expensive to manufacture due to numerous zippers which are costly in both manufacture time as well as sewing at the interior of the invention. Additionally it is uncomfortable to lie upon the interior zippers and straps. Finally, when in use, Agyagos lacks easily accessible storage pockets for valuables and sundry items.

U.S. Pat. No. 5,346,308 (Buhot et al) teaches a bag with a single storage pocket which converts to a beach towel. Unfortunately, as taught, Buhot provides only one pocket for storage which is not easily accessible when lying upon the towel. One pocket also will not allow any organization of items brought with the user. Further, as taught, Buhot is incapable of chair or seat mounting and is not easily manufactured due to its configuration.

U.S. Pat. No. 4,656,670 (Schluter) teaches a multi function beach towel which doubles as a bib and seat cover. However, Schluter as taught will not operate as a tote bag for articles being transported by the user. Additionally, in its chair mounted position, Schluter does not offer any easily accessible storage pockets for the user to store valuables. Further, as taught, Schluter requires cutting of the fabric used and seaming thereof which increases production costs.

U.S. Pat. No. 5,454,643 (Sullivan) teaches a combination beach towel and tote bag with a self enclosing pocket for the towel portion. However, Sullivan as taught, will not function as a chair cover, has no easily accessible pockets in use, nor does Sullivan teach sectional pockets that are easily accessible during the inventions use as a tote bag.

U.S. Pat. No. 3,176,315 (Freund) teaches a combination beach robe and blanket. However as taught, Freund offers no easily accessible sectional pockets for storage and it is incapable of chair mounting while concurrently allowing for easy access to pocket stored articles.

U.S. Pat. No. 4,634,618 (Greer et al) and U.S. Pat. No. 5,244,278 (Robitaille) both offer self containment of the towel portion of the combined towel and pouch inventions. Neither however offer chair or car seat mount capability while concurrently offering easy access to sectional pockets located upon the invention's surface. Additionally both are hard to manufacture due to the sewing requirements of placing zippers and exterior pockets upon a second piece of fabric.

None of the aforementioned inventions offer any locking or securing ability such that valuables may be secured inside the invention while in use as a chair cover or ground cover.

As such, there exists a need for an easily and inexpensively manufactured, combination beach or pool towel, which will convert to a self transporting tote bag having sectional pockets which are easily accessible while the invention is in use as a tote bag or while in use as a deck chair or automobile seat cover. There exists a further need in such an multi use item for the ability to lock or secure the combination towel tote bag invention during use such that it may be secured to a chair or other object with the closures upon the sectional pockets being concurrently securable or concealable.

SUMMARY OF THE INVENTION

Applicant's device is easily manufactured from conventional towel or bag materials such as terry cloth, rip stop nylon, or combinations thereof, into a combination tote bag, chair or auto seat cover and/or ground mat, which has easily accessed sectional storage compartments while in use in any of its three capabilities. The side opening storage compartments have the additional benefit of stealth, the fact that they exist on the invention is hard to see from more than a few feet away. It has optional ability using locks or proximity warning devices to supply a secure location for valuables and other items taken to the beach or pool by the user.

Applicant's invention is extremely easy to manufacture since it is formed from a single sheet of fabric which is sewed to the proper configuration. Conventional terry cloth towel fabric makes an excellent material since it is both soft on touch to the skin and durable for such a use. By placing most of the sewing at one end of the invention, close to perimeter edges, the labor to produce the invention is held to a minimum.

In use as a tote bag, the towel portion or tongue of the invention is folded up inside a towel pocket the size of which is defined by the length of the fold on one end of the towel material and the width of the towel itself. A carrying or shoulder strap made from synthetic material such as polypropylene or nylon is formed from a strap of such material sewn to the side of the towel pocket flap. This allows the user to have the convenience of a shoulder strap to carry the tote bag over a shoulder. Using optional grommets or other such aperture providing devices secured to the strap, the user can also optionally lock the strap, and attached bag and towel, to the deck chair upon which it rests or to some secure relatively unmoveable mount at the beach or pool such as a fence, a bike rack, a water faucet, or other affixation device available.

A side opening pocket or pockets located upon the opposite side from the towel or tongue portion of the invention allow for easy access to such pockets when the invention is used on a chair or auto seat or as a ground cover at the beach or pool. Closure for such pockets is accomplished by using conventional hook/loop releasable closure fabric such as Velcro®. While using fabric for such closure avoids the corrosion inherent to metal closures such as snaps or a metal zipper, such closures can be used. Additionally, by using hook loop fabric for closure, and towel fabric for the pocket walls themselves, the pockets are stealth in nature or have a hidden quality discouraging theft since their existence and therefor their contents are unknown to casual viewers.

During use as a tote bag, the invention features two side opening pockets formed by sewing a third fold in the towel fabric in an "accordion" style at the same end of the towel as the towel pocket. The mouths which define the opening to one or both side pockets are lined with hook and loop closure fabric which is sewn therein. A single pocket can be divided into two side opening pockets by a vertical stitch at a point where such a division is desired to yield the desired size pair of pockets. The hook and loop fabric used for pocket closure is normally manufactured from nylon or polyester however in this case the polyester fabric would be best to use since pool chlorine and sunlight has detrimental effects upon nylon. An additional benefit of the hook and loop fabric is the lack of corrosion in the wet and dirty environment of swimming pools and beaches. Plastic snaps, buttons, or zippers could be used however increased manufacture time would be incurred. Conventional metal snaps, button, or zippers for closing devices tend to corrode in such an environment, however they could also be used. The pocket or pockets so formed can also be lined with waterproof or liquid resistant fabric such as rip stop nylon or vinyl if a waterproof or resistant compartment is desired.

The pocket for the towel portion or "tongue" portion of the combined bag and towel invention doubles as a mount to hold the invention upon a standard lounge or deck chair commonly used on pool and boat decks. By slipping the top end of the chair above the user's head into the towel pocket, the invention can be used as a towel over the chair top and cure the vexing problem where the towel slips down when the head portion of the chair is elevated as is usually the problem when using a towel on most deck chairs. Optionally, grommets or other conventional reinforced aperture providing fasteners can be mounted in the mouth of the pocket or pockets allowing an optional locking devices such as a padlock to secure the pocket closed for storage of money, wallets, or other valuables out of sight and easy reach of parties inclined to abscond with such items.

Unique to this invention is the fact that the pockets formed upon the same end as the towel pocket, are easily accessible when the invention is in use on a chair as well as when used as a ground cover. By using side outlets for the mouth portion of the two pockets, they are easy to access and open at all times when mounted upon the chair thus allowing for the storage of valuables and necessities of relaxation out of sight from potential thieves and in an orderly fashion.

In the upright position on a chair with the chair in the towel pocket, the shoulder strap can also double as a restraint for the combination towel tote bag invention upon the chair. The strap can be pulled down on the back of the chair being used and placed under the conventional metal arm used to prop up the head portion of the chair. Also, as an option, the strap can be grommeted or have some other aperture placed therein and a locking device such a combination padlock, can be used to physically secure the strap to the back off the chair.

Indicia on one or both sides of the towel face offers the perfect place to for a hotel or cruise ships to advertise their facility and to mark the towel tote bag invention as owned by the facility. In this fashion users of the device whom are just issued the device with their hotel room or boat cabin, will also remember they should return it to the facility. The shoulder strap or some other portion of the invention could also be equipped with a magnetic or other conventional proximity device similar to those used in stores for clothing and libraries for books to remind persons if they are accidentally leaving without returning it to the towel clerk.

In summary, the present invention is an improvement over those towel and multi use towel and tote bag combinations now in use and known in prior art. It is novel and satisfies a long unmet need for an easily and inexpensively manufactured, combination beach or pool towel, which will convert to a self transporting tote bag having sectional pockets which are easily accessible while the invention is in use as a tote bag or while in use as a deck chair or automobile seat cover. It provides for further unmet needs for a multi use aforementioned item with the ability to lock or secure the combination towel tote bag invention during use such that it may be secured to a chair or other object with the closures upon the sectional pockets being concurrently secured.

The preferred configuration and manufacture of this invention uses conventional terry cloth fabric in conventional widths and a weight of about 9 ounces up to 17 ounces per linear yard to facilitate easy and inexpensive manufacture. Sewing is kept to a minimum using ultra violet light and chlorine resistant thread designed for the harsh environment of use.

An object of this invention is providing a combination tote bag and self enclosing towel with easily accessible pockets thereon.

Another object of this invention is to provide users with pocket enclosures for placement of valuables and necessities therein. Such pockets are easily accessible and useable by the user when the invention is chair or seat mounted or used as a deck mat.

A further object of this invention is to provide users with pockets for placement of valuables and necessities therein which are easily accessible and useable by the user when the invention is in its tote bag form.

Another object of this invention is to provide a combination tote bag/towel for use on cruise ships, pool decks, and at the beach which is easily configured to a ground mat or chair mat.

An additional object of this invention is to provide a combination tote bag/towel which has a pocket for mounting upon the upright portion of a deck chair in an inclined position to keep the towel from slipping down the incline or flying off the chair in the wind.

A further object of this invention is to provide the user with a tote bag/towel multi use invention with a shoulder strap for carrying the tote bag with the shoulder strap doubling as a restraining device for the towel on a chair or by securing it to some stationary device with a lock or the strap.

Another object of this invention is to provide a combination towel, tote bag, and chair cover which allows advertisers and facility owners to place indicia thereon for an advertisement of the facility or identification of ownership or geographic location for the invention.

An additional object of this invention is providing compartments or pockets for storage which are capable of waterproofing and are stealth or hidden by their construction.

A further object of this invention is to provide a combination towel, tote bag, and chair cover which allows the user to use it as a pillow or seat cushion by when the towel portion if folded within its holding pocket or when a pillow is inserted therein.

Further objects of the invention will be brought out in the following part of the specification, wherein detailed description is for the purpose of fully disclosing the invention without placing limitations thereon.

DETAILED DESCRIPTION OF THE PREFERRED EMBODIMENT OF THE INVENTION

Figure 1:
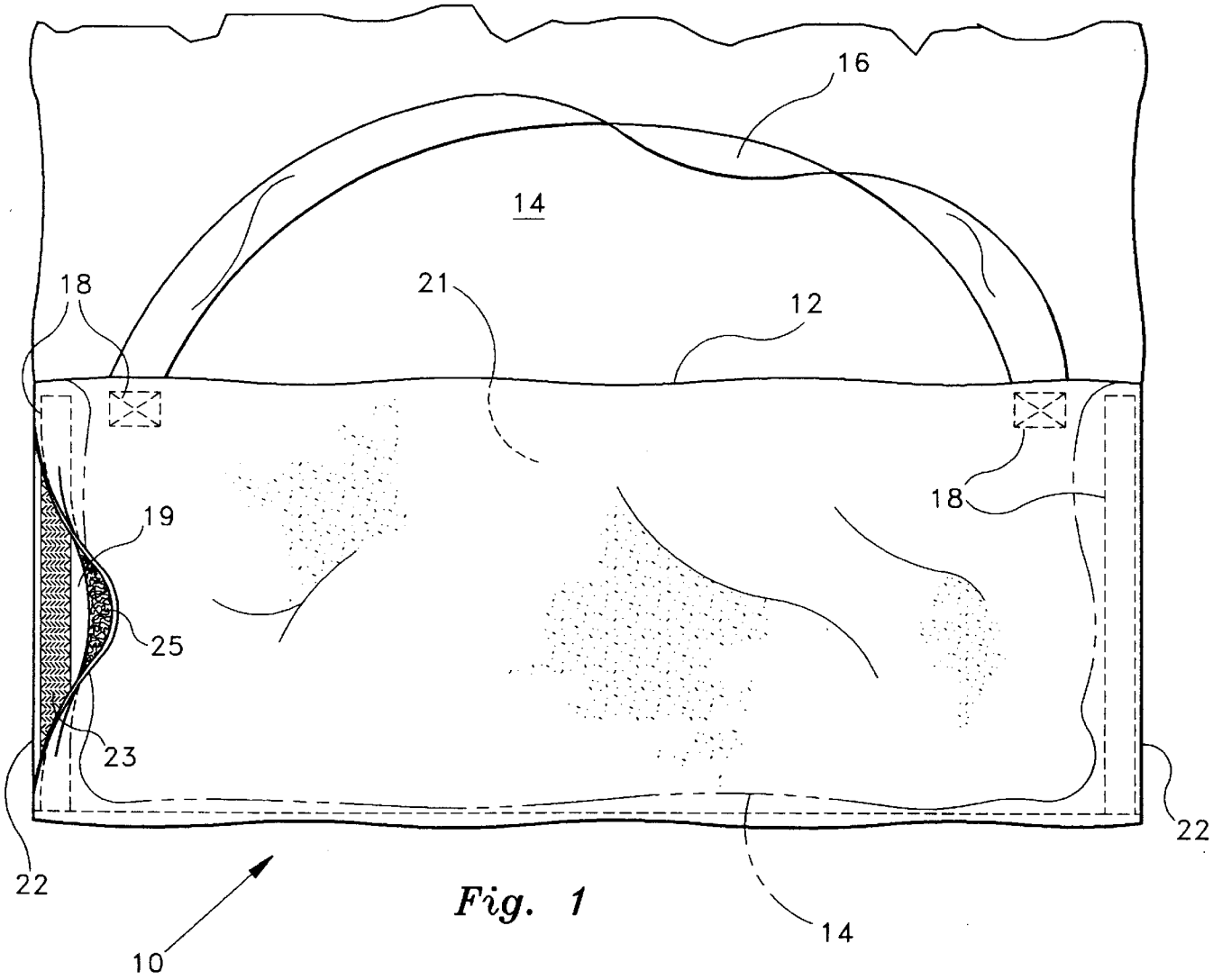
FIG. 1 is a frontal view of the invention showing the towel portion folded inside a towel pocket in phantom line.

Referring now to the drawing Figures, specifically FIG. 1 depicts the preferred embodiment of the invention in use as a shoulder mounted tote bag.

In use as a tote bag, (FIG. 1) the towel portion (14) or tongue of the invention is folded up inside a towel portion pocket 21 interior the size of which can be determined as need to hold the area and length of the towel portion 14 folded inside the pocket 21 and taking into consideration the width of conventional deck chairs and the width of conventionally manufactured terry cloth and other towel materials. With the towel portion 14 folded into its pocket 21 interior the invention can also function as a seat cushion for sports events or a pillow. An additional pillow, (now shown) could supplement the towel portion if more padding is desired, The towel portion pocket 21 interior may be waterproofed by lining it with a vinyl fabric or rip stop nylon or similar conventional waterproofing fabric if a waterproof pocket is desired. A carrying or shoulder strap 16 made from synthetic material with ultra violet light inhabitance such as polypropylene or nylon is formed from a desired length of such material sewn to the side of the towel pocket flap or front wall 28 of the invention. However it can be sewn elsewhere if the towel pocket opening 12 is kept reasonably upright during carrying. This allows the user to have the convenience of a shoulder strap 16 to carry the tote bag (FIG. 1) over a shoulder. Using optional grommets 17 or other such aperture providing devices secured to the strap, the user can also optionally lock the strap 16, and attached bag and towel invention, to the deck chair 34 upon which it rests or to some secure relatively unmoveable mount at the beach or pool such as a fence, a bike rack, a water faucet, (not shown) or other affixation device available.

Figure 2:
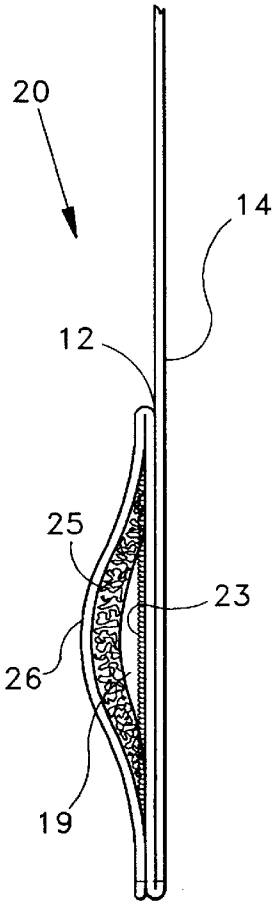
FIG. 2 is a view of the invention from one side showing the different pocket cavities.
Figure 3:
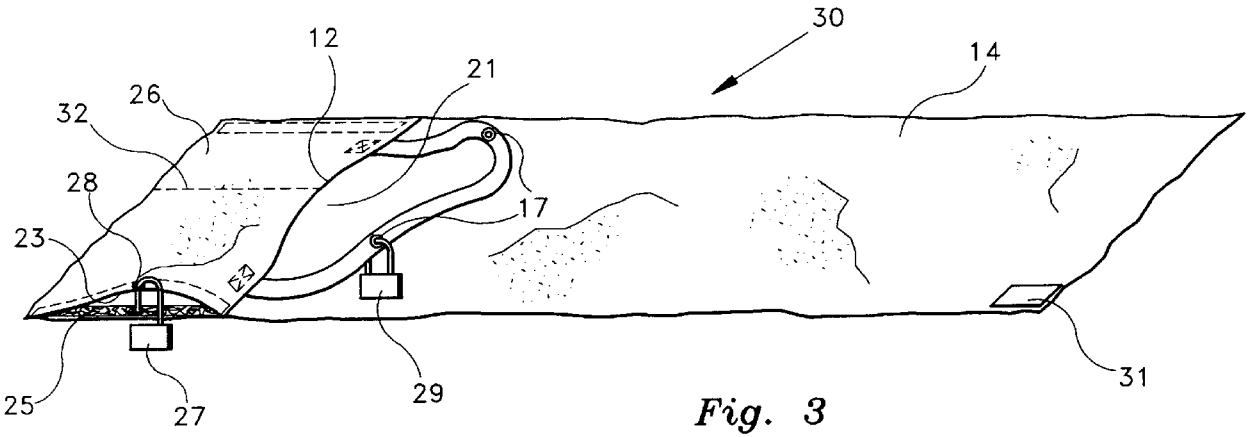
FIG. 3 is perspective view of the invention unfolded and in a deck mat position.

FIG. 2 depicts a side view of the invention showing a side opening storage pocket 22 or multiple pockets if divided into sections with stitching, located upon the opposite side from the towel pocket 21 for holding a towel portion 14 or tongue portion of the invention. Such placement allows for easy access to side opening pockets 22 when the invention is used on a chair or auto seat (FIG. 4) or as a ground cover at the beach or pool (FIG. 3). Additionally, the placement along with the use of the same fabric as used for the towel portion 14 conceals the pockets from thieves and helps to keep honest people honest by concealing valuables as well as the pocket containing them from obvious view.

Closure for such side opening pockets 22 is accomplished by using conventional hook/loop releasable closure fabric such as Velcro® 23 and 25 which is sewn onto both sides of the mouth of the side pocket 22. While using hook and loop fabric 23 and 25 for such pocket securing and closure avoids the corrosion inherent to metal closures such as snaps or a metal zipper, such metallic versions of closures can be used. Should waterproofing of the side opening pockets be desired, they may be lined on the inside with vinyl, ripstop nylon, or similar conventional waterproof and water-resistant fabrics.

Manufacture of the combination invention can be from as a unitary structure or by sewing individual pieces of cloth upon the main towel section 14. If manufactured as a unitary structure, the towel section 14 would be cut longer than necessary and thereafter folded back upon itself twice to form the tote or towel pocket and the side opening storage pocket sections by stitching 18 through the folded back portions. The invention could also be manufactured by sewing pieces of fabric upon the towel section 14 to form the tote or towel pocket 21 and a second piece of cloth sewn upon the towel portion 16 to form the storage pocket 19 with a first side pocket mouth 22 and a second side opening pocket mouth (not shown) distal to the first side opening pocket mouth 22. The storage pocket 19 while depicted on the opposite side of the towel portion 16 from the towel pocket 21, could in fact be mounted upon the front wall of the towel pocket 21 and achieve the same easy side access to the storage pocket or pockets 19 in all phases of use of the invention.

During use as a tote bag (FIG. 1), the invention features one or two side opening pocket enclosures 22 formed by sewing a third fold in the towel fabric in an "accordion" style at the same end of the towel as the towel pocket enclosure 21 in a unitary construction, or by sewing a strip of fabric of a size required to yield the desired sized side opening pockets 22 to the towel opposite to the side upon which the towel portion pocket 21 is placed. The side pocket mouths 22 which define the opening to one or both side pockets are lined with hook and loop closure fabric 23 and 25 which is sewn therein in a fashion to cooperate with the hook/loop fabric sewn upon the other side of the pocket opening 22. A single pocket can be divided into two side opening pockets 22 by a vertical stitch 32 at a point where such a division is desired to yield the desired size pair of pockets.

The hook and loop fabric 23 and 25 used for pocket closure is normally manufactured from nylon or polyester however in this case the polyester fabric would be best to use since pool chlorine and sunlight has detrimental effects upon nylon causing discoloration and failure of the nylon products. An additional benefit of the hook and loop fabric 23 and 25 for a closure device is the lack of corrosion inherent to metal closures in the wet and dirty environment of swimming pools and beaches. Plastic snaps, buttons, or zippers could be used also however increased manufacture time would be incurred. Conventional metal snaps, button, or zippers for closing devices while tending to corrode in such an environment, however they could also be used to close the side pockets 22.

Figure 4:
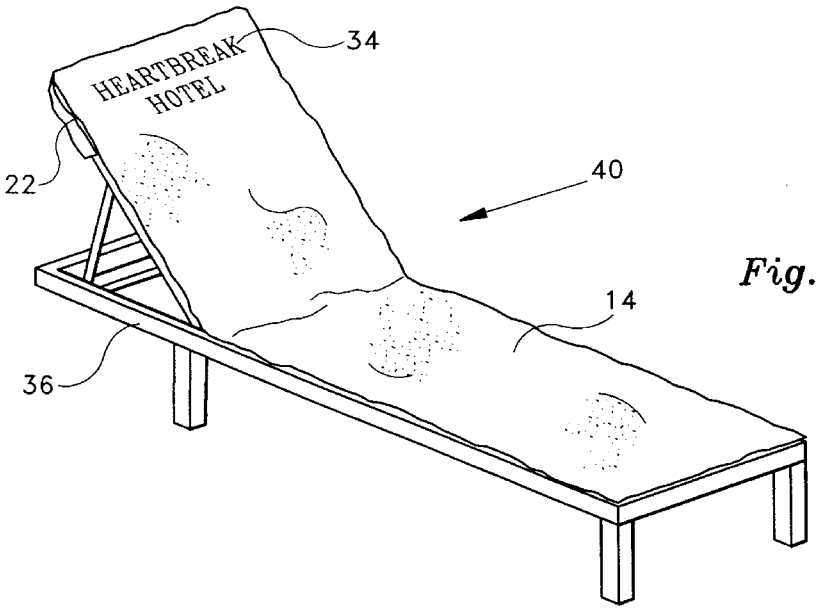
FIG. 4 is a perspective view of the invention mounted upon a deck chair by insertion of the chair head portion into the towel pocket.

The towel portion pocket 21 for enclosing and storing the towel portion 14 or "tongue" of the combined bag and towel invention doubles as a mount to hold the invention upon a standard lounge or deck chair commonly used on pool and boat decks (FIG. 4). By slipping the top end of such a deck chair above the user's head into the towel portion pocket 21, the invention can be used as a removably mounted deck chair cover thus curing the vexing problem of the towel slipping down when the head portion of the chair is elevated as is usually the problem when using a towel on most deck chairs.

FIG. 3 depicts the invention in a deck or beach use unfolded for ground cover. Also shown in this figure are optional grommets 28 or other conventional reinforced aperture providing fasteners can be mounted in the mouth 22 of the pocket or pockets allowing an optional locking devices 27 such as a padlock to secure the pocket closed for storage of money, wallets, or other valuables out of sight and easy reach of parties inclined to abscond with such items.

Unique to this invention is the fact that the pockets 22 formed upon the same end as the towel portion pocket, are easily accessible when the invention is in use on a chair (FIG. 4) or as well as when used as a ground cover (FIG. 3). By providing pockets with side access to the mouth portion 22 of the two pockets, they are easy to access and open at all times when mounted upon the chair thus allowing for the storage of valuables and necessities of relaxation out of sight from potential thieves and in an orderly fashion.

FIG. 4 depicts the invention removably mounted upon upright position on a conventional deck chair 36 with the upright or head portion of the chair in the towel portion pocket 21. The shoulder strap 16 can also double as a restraint for the combination towel tote bag invention upon the chair 36. The strap 16 can be pulled down on the back of the chair 36 being used and placed under the conventional metal arm used to prop up the head portion of the chair thus securing the multi use invention to the chair against wind. Also, as an option, the strap can be grommeted 17 or have some other aperture placed therein and a locking device 29 such a combination padlock, can be used to physically secure the strap to the back off the chair.

Indicia 34 on one or both sides of the towel face offers the perfect place to for a hotel or cruise ships to advertise their facility and to mark the towel tote bag invention as owned by the facility. In this fashion users of the device whom are just issued the device with their hotel room or boat cabin, will also remember they should return it to the facility. Optionally, the shoulder strap 16 or some other portion of the invention could also be equipped with a magnetic or other conventional proximity sensing device or alarm 31 similar to those used in stores for clothing and libraries for books to remind persons if they are accidentally leaving without returning it to the towel clerk.

While all of the fundamental characteristics and features of the multi use towel, tote bag, and seat cover invention have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A combination beach towel and chair cover and tote bag comprising:

a first rectangular fabric sheet having a width dimension, a length dimension, a top end, a bottom end, a first side edge, a second side edge, a front face, and a rear face;

a tote pocket means located upon said front face of said first rectangular fabric sheet at said top end of said first rectangular sheet having a tote pocket opening parallel to said bottom end of said first rectangular fabric sheet said tote pocket opening communicating with the interior area of said tote pocket;

said tote pocket means sized to accommodate the insertion of one end of a lounge chair therein;

a towel section defined by the area of said first rectangular sheet between said bottom end of said first rectangular sheet and said tote pocket opening, said towel section of a calculated size capable of being stored within said interior area of said tote pocket means;

a shoulder strap for carrying said combination beach towel and chair cover and tote bag affixed thereto whereby said tote pocket opening remains upright during transport of said combination beach towel and chair cover.

2. The combination beach towel and chair cover and tote bag as claimed in claim 1 further comprising, an aperture located in said shoulder strap; a locking means removably locateable through said aperture; whereby said shoulder strap may be secured to an object by attachment of said locking means, through said aperture, to said object.

3. The combination beach towel and chair cover and tote bag as claimed in claim 1 additionally comprising alarm affixed thereto.

4. The combination beach towel and chair cover and tote bag as claimed in claim 1 additionally comprising, at least one storage pocket located upon the rear face of said first rectangular fabric sheet, said storage pocket having a selectively closeable opening for access to an interior portion of said storage pocket.

5. A combination beach towel and chair cover and tote bag as claimed in claim 4 additionally comprising a liner located in said storage pocket, said liner comprised of water resistant material.

6. The combination beach towel and chair cover and tote bag as claimed in claim 1 wherein said lounge chair has an elevated end, and whereby said first rectangular fabric sheet is maintained in an upright position upon said elevated end of said lounge chair when said elevated end of said lounge chair is inserted into said tote pocket means.

7. The combination beach towel and chair cover and tote bag as claimed in claim 1 further comprising indicia located thereon.

8. The combination beach towel and chair cover and tote bag as claimed in claim 1 further comprising a pillow located in said tote pocket.

9. The combination beach towel and chair cover and tote bag as claimed in claim 1 additionally comprising, said tote pocket being sized to accommodate an elevated end of an automobile seat, whereby, said first rectangular fabric sheet functions as a protective seat cover for said automobile seat when said elevated end of said automobile seat is inserted into said tote pocket.

* * * * *